US005752990A

United States Patent [19]

Siskin et al.

[11] Patent Number: 5,752,990

[45] Date of Patent: May 19, 1998

[54] COMPOSITION AND METHOD FOR REDUCING COMBUSTION CHAMBER DEPOSITS, INTAKE VALVE DEPOSITS OR BOTH IN SPARK IGNITION INTERNAL COMBUSTION ENGINES

[75] Inventors: Michael Siskin, Randolph; Simon Robert Kelemen, Annandale, both of N.J.

[73] Assignee: Exxon Research and Engineering Company, Florham Park, N.J.

[21] Appl. No.: 625,456

[22] Filed: Mar. 29, 1996

[51] Int. Cl.[6] ..... C10L 1/22

[52] U.S. Cl. ..... 44/418; 44/420

[58] Field of Search ..... 44/418, 420

[56] References Cited

U.S. PATENT DOCUMENTS

| | | | |
|---|---|---|---|
| 1,924,722 | 8/1933 | Lovell et al. | 87/5 |
| 2,560,898 | 7/1951 | Schulze et al. | 44/63 |
| 2,706,677 | 4/1955 | Duncan et al. | 44/418 |
| 2,918,359 | 12/1959 | Lovett et al. | 44/418 |
| 2,919,684 | 1/1960 | Carr | 123/1 |
| 2,956,910 | 10/1960 | Giammaria | 134/22 |
| 2,962,439 | 11/1960 | Lauer | 252/25 |
| 3,197,292 | 7/1965 | Eckert et al. | 44/69 |
| 3,907,704 | 9/1975 | Murphy | 44/418 |
| 4,153,425 | 5/1979 | Graefje et al. | 44/71 |
| 4,173,456 | 11/1979 | Scheule et al. | 44/62 |
| 4,191,536 | 3/1980 | Niebylski | 44/63 |
| 4,203,730 | 5/1980 | Hanson | 44/71 |
| 4,217,111 | 8/1980 | Frost, Jr. | 44/418 |
| 4,240,803 | 12/1980 | Andress, Jr. | 44/63 |
| 4,295,861 | 10/1981 | Burns | 44/63 |
| 4,341,529 | 7/1982 | Burns | 44/63 |
| 4,527,996 | 7/1985 | Campbell | 44/72 |
| 4,614,522 | 9/1986 | Buckley | 44/63 |
| 4,832,702 | 5/1989 | Kummer et al. | 44/62 |
| 4,975,096 | 12/1990 | Buckley, III | 44/433 |
| 5,200,101 | 4/1993 | Hsu et al. | 252/47.5 |
| 5,223,127 | 6/1993 | Weers et al. | 44/420 |
| 5,298,039 | 3/1994 | Mohr et al. | 44/443 |
| 5,324,363 | 6/1994 | Robbins et al. | 134/39 |
| 5,350,429 | 9/1994 | Mohr et al. | 44/412 |
| 5,352,251 | 10/1994 | Lin et al. | 44/340 |
| 5,437,695 | 8/1995 | Mohr et al. | 44/418 |
| 5,458,660 | 10/1995 | Lin et al. | 44/340 |
| 5,458,661 | 10/1995 | Lin et al. | 440/418 |

FOREIGN PATENT DOCUMENTS

| | | | |
|---|---|---|---|
| 0062940 | 10/1982 | European Pat. Off. | C10L 1/14 |
| 0149486 | 7/1985 | European Pat. Off. . | |
| 0565285 | 10/1993 | European Pat. Off. | C10L 1/22 |
| 2610798 | 9/1977 | Germany | C10L 1/22 |
| 1383423 | 2/1975 | United Kingdom | C08F 8/32 |
| 1587949 | 4/1981 | United Kingdom | C10L 1/22 |
| 2259522 | 3/1993 | United Kingdom | C10L 1/14 |
| 91/12302 | 8/1991 | WIPO | C10L 1/14 |
| 92/15656 | 9/1992 | WIPO | C10L 1/14 |
| 93/06194 | 4/1993 | WIPO | C10L 1/22 |

*Primary Examiner*—Jacqueline V. Howard
*Attorney, Agent, or Firm*—Joseph J. Allocca

[57] ABSTRACT

Combustion chamber deposits and intake valve deposits in a spark ignition internal combustion engine which uses a liquid hydrocarbon or liquid hydrocarbon-oxygenate fuel, by using an unleaded fuel to which has been added an additive selected from the group consisting of low boiling alkyl pyridines, 4-vinylpyridine, DMF, N-formylpiperidine, sulfolane, polyolefin, polyether or polyether amine derivatives of DMF, amidene, or N-substituted-2 pyrrolidones, polyolefin in an amount of at least about 1,000 wppm and mixtures thereof. Functionalized polymer detergents can be used alone and added to the fuels in amounts in of about at least 3,000 wppm.

2 Claims, No Drawings

COMPOSITION AND METHOD FOR REDUCING COMBUSTION CHAMBER DEPOSITS, INTAKE VALVE DEPOSITS OR BOTH IN SPARK IGNITION INTERNAL COMBUSTION ENGINES

BACKGROUND OF THE INVENTION

1. Field of the Invention

The invention relates to a method for reducing combustion chamber deposits (CCD), intake valve deposits (IVD) or both simultaneously in spark ignition internal combustion engines which utilize unleaded liquid hydrocarbon or liquid hydrocarbon/oxygenated fuels, said method involving the addition of additives to the fuel to be burned, and to the additized fuel itself.

2. Description of the Related Art

The control of intake valve deposits (IVD) and combustion chamber deposits (CCD) and the control of the octane requirement increase (ORI) attributable to CCD has long been a subject of concern to engine and vehicle manufacturers, fuel processors and the public and is extensively addressed in the literature. Solutions to this problem and related problems of knock, icing, wear, oxidation, rust, etc., have taken the form of novel fuel additives, e.g., detergents, novel combination of additives and unique intake valve and combustion chamber configurations.

EP 561214 (CA 2091953) teaches a detergent-dispersant comprising diamino-alkane compounds substituted with aliphatic hydrocarbons having alkyl side groups of 250 to 5,000 mole weight. These detergent-dispersant additives are used in fuels in amounts ranging from 0.5 to 10 wt %.

DE 4142241 (CA 2082435) is directed to a fuel composition containing 10–5000 ppm nitrogen containing detergent (e.g., polyisobutylamine) and 10–5000 ppm of an alkoxylate which when combusted produced no deposits on the inlet system (fuel injectors/intake valves) of the test engine.

U.S. Pat. No. 5,437,695 teaches a fuel additive of the type

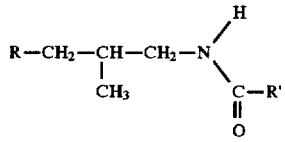

where R is an aliphatic residue of 250 to 5000 mol wt and R' is H, $C_1$–$C_6$ alkyl, phenyl, or $C_7$–$C_{14}$ alkyl-phenyl. The additive can be used in fuel at a concentration of 50–5000 ppm.

DE 3611230 (U.S. Pat. No. 4,832,702) is directed to a fuel containing a mixture of polyisobutyl amines which prevent deposits forming in engine intake systems and exhibit good dispersant action.

DT 2645713 (GB 1587949) teaches a detergent additive comprising a diamide of 12–20 carbon carboxylic acids and 2–6 carbon polyamines with 2–4 nitrogen atoms and the condensation product of 8–20 carbon carboxylic acids with 2–20 mols ethylene oxide and/or propylene oxide.

EP 565285 is directed to a fuel composition containing polyisobutene succinimide as a detergent and polyisobutyl polyamine which produced low intake valve deposits and no manifold deposits.

WO 9002784 (U.S. Pat. No. 4,975,096) teaches a hydrocarbyl amine comprising a long chain aliphatic hydrocarbyl component connected to the amine moiety through an oxyalkylene hydroxy group. The additive acts as a detergent minimizing ORI in unleaded fuels. When used at a concentration of 30–70 ppm the additive functions as a carburetor detergent while at concentrations of 2000 to 5000 ppm the additive cleans combustion chamber deposits.

U.S. Pat. No. 4,614,522 teaches a fuel dispersant-detergent additive consisting of modified polyamino alkenyl or alkyl succinimide used in a concentration range of 10 to 10,000 ppm.

U.S. Pat. No. 4,527,996 teaches a fuel additive comprising a hydroxy polyether polyamine used at a concentration of 250 to 5,000 ppm for controlling engine deposits.

U.S. Pat. No. 4,173,456 is directed to a gasoline additive comprising a hydrocarbon soluble acylated poly (alkylene amine) and 1–10 parts per part of the poly (alkylene amine) of a soluble polymer of a 2–6 carbon olefin (e.g., polypropylene or polyisobutylene). The acylated poly (alkylene amine) is used in an amount in the range 0.0004 to 0.04 wt % of the fuel and the polyolefin is used in an amount in the range 0.0004 to 0.2 wt % of the fuel.

U.S. Pat. No. 4,065,499 teaches a high molecular weight quaternary ammonium salt containing polyolefin groups as an ashless detergent used in an amount in the range 10 to 2,000 ppm.

WO 9215656 is directed to a polyolefin polyamine gasoline additive which reduces valve sticking and engine deposits. It is used at a concentration in the range 50 to 2000 ppm.

EP 8953 is directed to an alkenyl succinimide where the alkenyl group is derived from an olefinic mixture which is the bottoms from olefin oligomerization. The additive is used at a concentration in the range 0.00001 to 15 wt % of the fuel.

EP 62940 is directed to the control of ORI by adding to the fuel a mixture of aliphatic polyamine and low molecular weight polyolefin.

U.S. Pat. No. 5,200,101 is directed to arylamine/hindered phenol, acid anhydride and thioester derived multifunctional lube and fuel additives. When utilized in fuels they are employed in amounts of from 25 to 500 pounds of additive per 1000 barrels of fuel (about 100 to 2,000 wppm). Detergent, cleanliness, combustion improvement and related fuel improvement properties are reportedly expected.

U.S. Pat. No. 4,341,529 is directed to a liquid hydrocarbon fuel containing n-alkyl derivatives of 2-aminopyridine (e.g., $C_5H_4NCH_2NH_2$) as ashless anti-knock agents. They are employed at concentrations in the range 5,000 to 100,000 ppm.

U.S. Pat. No. 3,197,292 is directed to anti-knock additive for motor fuel composed of a salt formed from selenious acid ($H_2SeO_3$) and a hydrocarbylamine (RNR'R") in 0.01 to 5 vol %. Preferred hydrocarbyl radicals of the amines contain 3–28 carbon atoms and are aliphatic, but can be aryl, alkaryl, alicyclic, anilines, naphthylamines, and can include heterocycles (pyridine, lutidines, quinoline, piperidine, morpholline, pyrrolidine). Organolead anti-knock agents can be used with their agent. It is preferred to combine the acid and amine in 1:1 molar proportions, but an excess of the amine over two moles can be employed to improve solubility of the salt.

U.S. Pat. No. 2,919,684 is directed to anti-icing additive (0.001 to 0.9 wt %) for carburetted internal combustion engines consisting of individual or a mixture of mono- or disubstituted alkyl- and/or alkenyl pyridines having 1–6 carbons in the chain and which boil above 70° C. at 10 mm of Hg. These can be admixed with other anti-icing agents. This patent deals with leaded gasolines or carburetted engines.

U.S. Pat. No. 2,560,898 is directed to aviation fuel additive, to improve effective operation and power output for 90+ octane fuels, consisting of substantially pure compounds or mixtures of a monomethyl or polymethyl substituted pyridine in 1–20 vol %. At the time of the patent these fuels were leaded.

U.S. Pat. No. 2,962,439 is directed to fuel and lubricant additive for reducing combustion chamber deposits consisting of a "combination" additive of a pyridine, picoline, picoline isomer, piperidine, quinoline, isoquinoline, quinaldine, and mixtures thereof, together with an anhydrous copper salt. At column 1, lines 54–65, it is indicated that the individual components could reduce combustion deposits to a minor extent, however, the combination exhibits a beneficial synergism. The example in Table 1 (column 2) shows a 0.57 and a 1.6% benefit, ex-situ, for quinoline alone and in the presence of copper chromite, respectively; not a larger benefit, especially in a test tube. But, the other examples, in-situ, are all paper examples. The additive combination is used at 0.05 to 5.0 wt % with a 4:1 minimum molar ratio of Cu salt to organic compounds. Organometallic anti-knock additives such as TEL can be present.

U.S. Pat. No. 4,341,529 is directed to ashless anti-knock fuel additive comprising selected N-alkyl derivatives of 2-aminopyridine. From the specification, the abstract should read alkyl substituted aminopyridine derivatives (column 1, lines 13, 51, 58). They are employed in high concentrations of 0.5 to 10 wt % (5,000 wppm minimum). It has been found, however, that high concentrations of such structures have a negative impact on CCD.

U.S. Pat. No. 4,295,861 is almost identical to U.S. Pat. No. 4,341,529 above, except for using N-substituted amine derivatives of 3-hydroxypyridine as the ashless anti-knock additive. The patents cover 2-alkyl- and dialkyl aminomethylpyridines with a hydroxyl group at position 3 of the ring. Also at position 2 these materials include piperidinomethyl, pyrrolidinomethyl and morpholinomethyl groups. Again, concentrations range from 0.5 to 10 wt %, but in cases of limited solubility can be as low as 0.1 wt %. The aminomethyl functionality ($CH_2NH_2$) allows substitution of, e.g., piperdines, pyrrolidones, morpholines onto the nitrogen and forms what is referred to as a carbon bridge.

U.S. Pat. No. 2,956,910 is directed to removal of combustion deposits from the metal parts of an internal combustion engine by applying N-methyl-2-pyrrolidone to the preferably heated deposits preferably without disassembling the engine (sprayed through the spark plug hole, or into carburetor intake of an idling engine) and then removing the loosened deposits after a 1–6 hour soaking period by blowing them out through the exhaust. It can be used in combination with other solvents (25–75%) which include amides (formamide, dimethylformamide).

U.S. Pat. No. 1,924,722 is directed to the application of any aliphatic amide, especially diethylformamide, to carbon coated parts that have been heated to above 150° F. Admixture with benzene and alcohol increases the solvent action of the aliphatic amides. The engine does not necessarily have to be disassembled.

U.S. Pat. No. 5,324,363 is directed to the treatment of carbonaceous deposits on combustion chamber or other metal surfaces with weak amines (bases) (0.01–2.0 molar) such as aqueous ethylenediamine aids, at 0°–100° C., in their removal and thereby reduces octane requirement of an internal combustion engine. Substantial disassembly of the engine is not required. Soak times of 10 minutes to 1 hour are used followed by operating the engine for 5 to 30 minutes to provide agitation. Group I metal carbonates, bicarbonates, phosphates, sulfates, etc., and mixtures thereof with organic amines can be employed.

DT 2610798 teaches a motor fuel composition containing 10–2,000 ppm of phthalic acid diamides which prevent carburetor and valve deposits.

DT 2531469 teaches a detergent additive for gasoline consisting of dialyklamides of dialkylamine alkane acids used in amounts in the range of 10–2,000 ppm which clean carburetors of deposits without redeposition on intake valves.

GB 1,383,423 teaches a method for preparing an alkylpolyamine by reacting an α olefin of ≧15C of mol wt 200–5000 with a polyamine in the presence of a free radical initiator. The composition is useful as a gasoline additive at a concentration of 50–2000 ppm to eliminate gummy deposits from carburetors.

WO 93/06194 teaches a fuel additive comprising a polyisobutenyl succinimide in a non-volatile paraffin or napthenic carrier fluid useful as an intake valve detergent.

GB 2259522 teaches a fuel additive concentrate comprising the reaction product of a polyamine with at least one acyclic hydrocarbyl substituted succinic acylating agent and a mineral oil of VI less than 90 and volatility less than 50%. The additive reduces intake valve deposits.

WO 91/12302 teaches a deposit control additive for gasoline comprising an oil soluble polyolefin polyamine. The additive is used in an amount in the range 20–2,000 ppm.

U.S. Pat. No. 4,191,536 is directed to a process whereby the exhaust hydrocarbon emissions and CCD of an internal combustion engine being operated on gasoline containing a cyclopentadienyl manganese (tricarbonyl) antiknock additive are reduced by the addition of a saturated cyclic ether, such as tetrahydrofurn a (THF) (15–100 g/gallon) (56–376 ppm).

DESCRIPTION OF THE INVENTION

This invention relates to a composition and method for decreasing combustion chamber deposits (CCD), intake valve deposits (IVD) or both simultaneously in spark ignition internal combustion engines run on unleaded gasoline base fuel, such base fuel typically comprising liquid hydrocarbon and mixed unleaded liquid hydrocarbon/oxygenate fuels, said deposits being controlled by adding to the fuel or to the lubricating oil, preferably to the fuel, certain additional additives selected from the group consisting of, in addition to other additives which may be present therein, a mixture of alkyl pyridines boiling below about 200° C., 4-vinylpyridine, dimethylformamide, N-formylpiperidine, polyolefin in an amount of at least about 1000 ppm, sulfolane, polyolefin, polyether or polyether amine substituted amidene or alkyl amidene, N-formyl polyolefin, polyether or polyether amine amine, N-polyolefin, polyether or polyetheramine-2-pyrrolidone, ditridecylthiodipropionate, and mixtures thereof added to the fuel in an amount (unless otherwise stated above) in the range 50 to 5,000 ppm, preferably 100 to 2,500 ppm, most preferably 100–1000 ppm, and functionalized polymeric detergents selected from the group consisting of polyolefin amine and polyether amines used alone at concentrations of at least about 3000 ppm. Two or more of the same or different additive groups can be linked through bridging groups such as a sulfide, disulfide, $(—CH_2—)_n$ when n is 1–4, ether, ester, thioester, acetal, hemiacetal and secondary amine. The invention also relates to unleaded hydrocarbon or mixed unleaded hydrocarbon/oxygenated fuels containing the aforesaid additive materials.

The fuels which may be additized either by blending or by separate injection of the additive directly into the gas tank or into the engine utilizing such fuels, can be ordinary unleaded gasoline, of any grade, containing other, typical fuel additives, ordinarily added to such fuels, e.g., other detergents, deicing additives, anti-knock additives, corrosion, wear, oxidation, anti-rust, etc., additives known to the art. As is readily apparent and already known in the industry, however, the skilled practitioner will have to ensure compatability between the additives employed. The fuel can also be any of the currently fashionable reformulated gasolines, i.e., those containing various oxygenated compounds such as ether (MTBE, ETBE, TAME, etc.) or alcohols (methanol, ethanol) in various concentrations.

Specific additives include alkyl pyridines boiling below about 200° C., N-polyisobutenyl-2-pyrrolidone, N-methyl-N-formylpolyisobutenylamine, N-formylpolyisobutenylamine, N-polyisobutenylisopropylamidene, N-formylpiperidine, 4-vinylpyridine, N,N-dimethylformamide, N-methylpyrrolidone, sulfolane, and mixtures thereof.

Unfunctionalized polymers can also be employed either alone or in combination with the other materials recited above. These polymers are of moderate molecular weight.

Preferred polyolefins include: polybutylene, polyisobutylene, polystyrene and their ethylene and propylene co-polymers (MW 800–2000).

These unfunctionalized polymeric materials are employed at concentrations of at least 1000 ppm, preferably >3,000, most preferably >5,000 ppm.

Conventionally functionalized polymeric detergents can also be employed, however, to contribute to the control of combustion chamber deposits they must be used at concentrations greater than those at which they are normally employed to control intake valve deposits. Such materials are employed in the present invention at concentration >3,000 ppm, more preferably greater than 5,000 ppm. They are typically of about 2,000 and less number average molecular weight.

Examples of functionalized polymeric detergents include polyolefinic amines, polyolefinic succinimides, polyolefinic ether amines, polyolefin oxides, polyvinyl pyridines, n-alkyl pyrrolidones and their copolymers with olefins or dienes.

The polymers employed are those which depolymerize at the conditions typically encountered in the engine combustion chamber, i.e., about 400° C. and less in a typical spark ignition internal combustion engine. Preferred polyolefin amines include: polybutylene amine, polyisobutylene amine, polypropylene amine (MW 800–2000); preferred polyetheramines include: polyethylene oxide amines, polypropylene oxide amines, polybutylene oxide amines, polyisobutylene oxide amines (MW 800–2000).

The additives described above can be added directly to the gasoline or separability injected into the fuel system of the engine. Alternatively, the additives can be added to the lubricating oil and from that environment favorably affect CCD and IVD. The additives can also be encapsulated to overcome any odor, toxicity or corrosivity concerns which may arise with any one or group of additives within the aforesaid recitations.

The invention is further illustrated by the following non-limiting examples and comparison.

EXAMPLE 1

In this example the effectiveness of 4-vinylpyridine and a mixture of low boiling alkyl pyridines (boiling range 165°–190° C.) for intake valve and combustion chamber deposit control was evaluated. The engine test beds, additive concentrations, base fuel and results are presented in Table 1.

TABLE 1

| | LeSabre (6 Cylinder) | | Honda (2 Cylinder) | | |
|---|---|---|---|---|---|
| | CCD | IVD | CCD | | IVD |
| | (g/Cyl) | (mg/valve) | (g/Cyl) | (μm) | (mg/valve) |
| Base Fuel I[1] | 2.33[2] | 705[2] | 0.70 | 97 | 109 |
| Base Fuel I[1] | 1.91[3] | 731[3] | | | |
| Base Fuel I + LAP[4] | 1.82[3] | 769[3] | 0.64 | 76 | 91 |
| Base Fuel I + 4-VP[5] | 1.60[3] | 676[3] | 0.66 | 76 | 85 |

[1]Unadditized 93 RON unleaded gasoline, RVP 6.65, 11.99 wt % MTBE
[2]LeSabre engine A
[3]LeSabre engine B
[4]Mixture of low boiling alkyl pyridines (165–190° C.) at 500 wppm in Base Fuel I
[5]4-vinylpyridine at 500 wppm in Base Fuel I The LeSabre test involved running the engine for 109 hours, the equivalent of about 5,000 miles. The air/fuel ratio was 14.7. Engine rpm was varied between 1260 to 1694 as engine cycled at different speeds. Coolant temperature was about 181° F. inlet, 200° F. outlet, oil temperature was about 228° F.

The two cylinder Honda test engine (ES 6500 Honda Generator) test involved running the engine continuously for 20 hours at a constant 3,000 RPM and 2,400 W power. The air/fuel ratio was 12.1–12.3 and the engine coolant temperature was 180° F. For both test systems after each test the deposits on the intake valves were weighed and in the combustion chambers (head and piston top) were collected and weighed. In addition, for the Honda test prior to collecting the CCD, the thickness of the deposits in each combustion chamber was recorded at 81 different points using an eddy current probe (Permascope-model D211D, Fischer Technology Inc.). The average CCD thickness was determined from these data.

EXAMPLE 2

The same additives, 4-vinylpyridine and a mixture of low boiling alkyl pyridines (boiling range 165°–190° C.) were evaluated for control of intake valve and combustion chamber deposits. Higher concentrations of additives were used as compared to Example 1. The engine test, additive concentration, base fuel and results are presented in Table 2 which were collected using the technique recited in Example 1.

TABLE 2

| | Honda (2 Cylinder) | | |
|---|---|---|---|
| | CCD | | IVD |
| | (g/Cyl) | (μm) | (mg/Valve) |
| Base Fuel II[1] | 0.80 | 121 | 131 |
| Base Fuel II + LAP (500 wppm) | 0.74 | 111 | 159 |
| Base Fuel II + LAP (2000 wppm) | 0.68 | 91 | 147 |
| Base Fuel II + 4-VP (500 wppm) | 0.77 | 127 | 118 |
| Base Fuel II + 4-VP (2000 wppm) | 0.63 | 76 | 134 |

[1]unadditized 92-93 RON unleaded gasoline

EXAMPLE 3

In this example the effectiveness of 1300 MW polyisobutylene (BASF glissipal 1300) was evaluated for control of IVD and CCD. Deposit levels were determined by the Permascope method described in Example 1.

Table 3 shows the results for CCD and IVD after running the Honda test engine on base fuel and after adding 10,000 ppm glissipal 1300. The results for this base fuel with a conventional detergent/fluidizer combination is included for comparison. A significant reduction in the amount of CCD and IVD is achieved upon addition of glissipal 1300 at the enhanced concentration level. A polymer-like film that was soluble in pentane was observed in the combustion chamber after the run with glissopal 1300.

TABLE 3

| Honda | CCD TCD[1] (grams) | CCD Thickness (μm) | IVD (mg/valve) |
|---|---|---|---|
| Base Fuel II | 0.80 | 121 | 131 |
| Base Fuel II + 1,373 wppm conventional detergent/ fluidizer | 1.07 | 157 | 15 |
| Base Fuel II + 10,000 wppm polyisobutylene | 0.17 | 26 | 22 |
| Base Fuel III[2] | 0.77 | 110 | 67 |
| Base Fuel III + 3,000 wppm polyisobutylene | 0.30 | 76 | 17 |

[1]Total Chamber Deposits
[2]a 93 RON unadditized unleaded gasoline, RVP 11.29, 13.91/0.02 MTBE/ETBE

EXAMPLE 4

In this example 80% polyisobutylene amine/20% polybutylene oxide (BASF AP82) was evaluated for the control of IVD and CCD. The same engine test bed, operating conditions and analytic techniques as used in Example 3 were used in this Example.

Table 4 shows the results for CCD and IVD after running the Honda test engine on base fuel and after the adding different amounts of AP82 to base fuel. A significant reduction in the amount of CCD and IVD is achieved upon addition of AP82 at enhanced concentration (>500 ppm). A polymer-like film that was soluble in pentane was observed in the combustion chamber after the additive runs.

TABLE 4

| Honda (2 Cylinder Engine) | CCD TCD* (grams) | CCD Thickness (μm) | IVD (mg/valve) |
|---|---|---|---|
| Base Fuel II | 0.80 | 121 | 131 |
| Base Fuel II + 500 ppm AP82 | 0.77 | 120 | 17 |
| Base Fuel II + 2,500 ppm AP82 | 0.59 | 83 | 0 |
| Base Fuel II + 10,000 ppm AP82 | 0.05 | 13 | 0 |

*Total Chamber Deposits

EXAMPLE 5

In this example ditridecylthiodipropionate (DTDTDP) was evaluated for the control of IVD and CCD. The same test engine, operating conditions and analytic techniques as used in Example 3 were employed in this Example.

Table 5 shows the Honda test engine results for CCD and IVD for base fuel and after addition of different amounts of DTDTDP. A significant reduction in the amount of CCD and IVD is achieved upon addition of DTDTDP.

TABLE 5

| Honda SETI | CCD TCD* (grams) | CCD Thickness (μm) | IVD (mg/valve) |
|---|---|---|---|
| Base Fuel IV[1] | — | 151 | 110 |
| Base Fuel IV + 600 ppm DTDTDP | | 115 | 80 |
| Base Fuel II | 0.80 | 121 | 131 |
| Base Fuel + 1200 ppm DTDTDP | 0.74 | 103 | 24 |
| Base Fuel + 10,000 ppm DTDTDP | 0.52 | 81 | 5 |

*Total Chamber Deposits
[1]unadditized 92/93 RON unleaded gasoline

EXAMPLE 6

Deposit levels using base fuel plus recited additives versus base fuel without the additives in a Buick LeSabre engine, and in Honda 2 cyclinder test engines expressed in terms of wt % over/under base fuel are reported in Tables 6 and 7 for a variety of additives. As is readily apparent, the performance of any particular chemical as a CCD/IVD additive is highly unpredictable, the presence of as little as one methyl group or the substitution of ethyl groups for methyl groups being sufficient to differentiate between materials which function as CCD/IVD additives and those that do not.

TABLE 6

Deposit Levels vs. Base Fuel in Buick LeSabre Engine

| | Wt % Over/Under Base Unleaded 93 Octane | |
|---|---|---|
| | CCD | IVD |
| BASE CASES | | |
| Unleaded 93 Octane (unadditized) | — | — |
| Commercial Premium Fuel A (additized) | +70 | −88 |
| Commercial Premium Fuel B (additized) | +21 | −84 |
| ADDITIVES | | |
| LAP[1], 500 wppm | 3'5 | +5 |
| HAP[2], 500 wppm | +29 | +135 |
| 4-VP[3], 500 wppm | −16 | −4 |
| 4-VP[3], 10,000 wppm | −75 | −98 |
| 4-VP[3] + AP82 (500 wppm each) | +28 | −87 |
| 4-VP[3] + Commercial Fuel B | +33 | −80 |
| 4-VP[3] + DTDTDP[4] (500 wppm each) | 0 | −15 |
| 4-VP (12 hour soaks) (500 wppm) | −9 | 0 |
| LAP + AP82 (500 wppm each) | +29 | −91 |
| LAP (500 wppm) + Commercial Fuel B | +22 | −71 |
| NMP[5], 500 wppm | −11 | −15 |
| NMP (500 wppm) + Commercial Fuel B | +24 | −73 |
| NMP + Sulfolane (250 wppm each) | −31 | −2 |
| Sulfolane, 500 wppm | −3 | +26 |
| N-Formyl Pip, 500 wppm | −14 | +12 |
| 2-Pip$CH_2NH_2$, 500 wppm | +34 | +9 |
| 4-t-BuPip, 500 wppm | +3 | +25 |
| 3,5-DMPip, 500 wppm | −4 | +2 |
| 3,5-DMPyr, 500 wppm | −2 | +17 |
| $(C_3H_7)_3N$, 500 wppm | −5 | +42 |
| THQ, 500 wppm | −10 | +20 |
| Aniline, 500 wppm | −23 | +25 |
| N-MeAniline, 500 wppm | −16 | +18 |
| Formamide, 500 wppm | +6 | +88 |
| N-Methylformamide, 500 wppm | 0 | +55 |
| N,N-Diethylformamide, 500 wppm | +48 | +38 |
| N,N-Dibutylformamide, 500 wppm | +48 | +4 |
| N,N-Dimethylformamide, 500 wppm | −14 | −18 |
| DMF (500 wppm) + Commercial Fuel B | +33 | −64 |
| (AP82) PIBA, 500 ppm | +26 | −91 |
| PIB 10,000 wppm (mol wt 1,000) | −73 | −52 |

TABLE 6-continued

Deposit Levels vs. Base Fuel in Buick LeSabre Engine

| | Wt % Over/Under Base Unleaded 93 Octane | |
|---|---|---|
| | CCD | IVD |
| PIBA (AP82), 100,000 wppm | −75 | −98 |
| PIBA – DMF, 500 wppm (amidene) | +42 | −78 |
| PIBA – 4-VP, 500 wppm (20 amine) | +80 | −96 |

(1)Mixture of low boiling alkyl pyridines (156–190° C.)
(2)Mixture of high boiling alkyl pyridines (204–361° C.)
(3)4-Vinylpyridine (121° C. at 150 mm of Hg)
(4)Ditridecylthiodipropionate
(5)N-Methylpyrrolidone (bp 202° C.)
Other abbreviations:
Pip = piperidine;
Pyr = pyridine;
M = methyl;
DM = dimethyl;
t-Bu = tertiary butyl;
THQ = 1,2,3,4-tetrahydroquinoline;
PIB = polyisobutylene;
PIBA = polyisobutylene amine

TABLE 7

DEPOSIT LEVEL VS. BASE FUEL IN HONDA 2 CYLINDER ENGINE

| | Wt % Over/Under Base Unleaded 93 Octane | |
|---|---|---|
| | CCD | IVD |
| Base Cases | | |
| Base Fuel I or III (no additives) | — | — |
| Commercial Premium Fuel A (additized) | +40 | −92 |
| Commercial Premium Fuel B (additized) | | |
| Additives in Unleaded 93 Octane | | |
| High Boiling Alkylpyridines, 500 wppm | +39 | −20 |
| Low Boiling(1) Alkylpyridines, 500 wppm | −5 | −20 |
| N,N-Dimethylformamide (DMF), 500 ppm | −15 | −23 |
| Sulfolane, 500 wppm | −10 | −39 |
| N-Polyisobutenylisopropylamidene (PIBA-DMF), 500 wppm | −18 | −96 |
| N-Formylpolyisobutenylamine (PIBA-FORM), 500 wppm | −11 (−25) | −56 (−69) |
| N-Methyl-N-Formylpolyisobutenylamine (PIB-MF), 500 wppm | −20 (−22) | −50 (−64) |
| N-Polyisobutenyl-2-pyrrolidone (PIB-NMP), 500 wppm | −1 (−4) | −79 (−88) |
| Ditridecylthiodipropionate (DTDTDP), 500 wppm | −8 | −82 |
| 4-Vinylpyridine, 500 wppm | −20 | −22 |

TABLE 7-continued

DEPOSIT LEVEL VS. BASE FUEL IN HONDA 2 CYLINDER ENGINE

| | Wt % Over/Under Base Unleaded 93 Octane | |
|---|---|---|
| | CCD | IVD |
| Glissipal (1300 mol wt PIB), 3000 wppm | −62 | −75 |
| Glissipal (1300 mol wt PIB), 6000 wppm | −67 | −75 |

(1)Boiling range, 156–190° C.

COMPARATIVE EXAMPLE

Deposit levels in a Honda 2 cylinder test engine run on leaded and unleaded unadditized fuels to which were added 500 wppm quantities of 4-vinylpyridine and low boiling point alkyl pyridines are reported in Table 8. It is seen that additives which are effective in reducing CCD in unleaded fuels are ineffective and in fact detrimental when used in leaded fuels.

TABLE 8

2 Cylinder Honda Engine, 20 Hours

| | CCD (wt % above/below base fuel) |
|---|---|
| Base Fuel (93 RON unleaded) | — |
| Base Fuel + 4-VP(1) (500 ppm) | −20 |
| Base Fuel + LAP(2) (500 ppm) | −5 |
| Base Fuel + 1.8 g Pb(3) + 4-VP (500 ppm) | +87 |
| Base Fuel + 1.8 g Pb(3) + LAP (500 ppm) | +92 |

(1)4-VP = 4-vinylpyridine
(2)LAP = mixture of low boiling alkyl pyridines (bp < 200° C.)
(3)1.8 grams of lead (as the metal) per gallon of gasoline, added in the form of TEL

What is claimed is:

1. An unleaded gasoline for reducing combustion chamber deposits, intake valve deposits on both comprising a major amount of an unleaded gasoline base fuel and from 100 to 1000 ppm of an additive selected from the group consisting of N,N-dimethyl formamide, N-methyl-N-formyl polyisobutenyl amine and N-polyisobutenylisopropylamine and mixtures thereof.

2. A method for reducing combustion chamber deposits, intake valve deposits or both in an internal combustion engine run on unleaded gasoline by running said engine on the gasoline of claim 1.

* * * * *

UNITED STATES PATENT AND TRADEMARK OFFICE

CERTIFICATE OF CORRECTION

PATENT NO. : 5,752,990
DATED : May 19, 1998
INVENTOR(S) : Michael Siskin; Simon Robert Kelemen

It is certified that error appears in the above-identified patent and that said Letters Patent is hereby corrected as shown below:

In the claims:

Claim 1, line 45, delete "N-polyisobutenylisopropylamine", insert --N-polyisobutenylisopropylamidine-- .

Signed and Sealed this

Fifteenth Day of June, 1999

*Attest:*

Q. TODD DICKINSON

*Attesting Officer*

*Acting Commissioner of Patents and Trademarks*